US007134834B2

(12) United States Patent
Molitor

(10) Patent No.: US 7,134,834 B2
(45) Date of Patent: Nov. 14, 2006

(54) FLOW COMPENSATION FOR TURBINE CONTROL VALVE TEST

(75) Inventor: Michael James Molitor, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 121 days.

(21) Appl. No.: 10/953,268

(22) Filed: Sep. 30, 2004

(65) Prior Publication Data

US 2006/0067810 A1 Mar. 30, 2006

(51) Int. Cl.
*F04D 27/02* (2006.01)
*F04D 27/00* (2006.01)

(52) U.S. Cl. ..... 415/1; 415/36; 415/42; 73/118.1

(58) Field of Classification Search ..... 415/1, 415/17, 26, 29, 36, 42, 44; 73/118.1, 47, 73/49.7

See application file for complete search history.

(56) References Cited

U.S. PATENT DOCUMENTS 4,512,185 A 4/1985 Ghrist, III

FOREIGN PATENT DOCUMENTS

JP 59023003 A 2/1984
JP 62091605 A 4/1987
JP 09189204 7/1997

OTHER PUBLICATIONS

Search Report for corresponding U.K. Patent Application No. GB0519064.0, dated Jan. 10, 2006.

*Primary Examiner*—Edward K. Look
*Assistant Examiner*—Dwayne J. White
(74) *Attorney, Agent, or Firm*—Nixon & Vanderhye P.C.

(57) ABSTRACT

The present invention is a method of minimizing steam boiler pressure changes or turbine power changes during turbine control valve operational safety test stroking. The method of the present invention uses control valve positions as feedback into a compensation algorithm to minimize flow disturbance caused by the closing and reopening of a turbine control valve during periodic operational testing. By maintaining the total mass flow through several parallel turbine inlet control valves constant, the steam generator pressure is maintained constant, and the inlet pressure regulator is unaffected during inlet control valve testing. Maintaining the total mass flow through several parallel turbine inlet control valves constant also minimizes turbine power changes during inlet control valve testing. In addition, the monitoring of additional process parameters is not needed. The position (valve stem lift) of the individual parallel valves is used for closed loop control of inlet valve position, and is sufficient for the purpose of maintaining constant flow.

14 Claims, 6 Drawing Sheets

CV test with pressure regulator and flow compensation function

FLOW COMPENSATION FOR TURBINE CONTROL VALVE TEST

The present invention relates to turbines, and, in particular, to a method of minimizing flow disturbance caused by the closing and reopening of turbine control valves during periodic operational testing, and specifically, to using control valve positions as feedback to minimize such flow disturbance.

BACKGROUND OF THE INVENTION

Required operating procedure for turbines includes periodic operational testing (closing and reopening) of parallel inlet flow control valves used in turbines. The testing is done to confirm operability of turbine safety mechanisms. One problem with such testing is changes in the turbine steam boiler pressure or changes in turbine power as a result of the closing and reopening of the turbine control valves during the periodic operational test. Steam boiler pressure changes or turbine power changes must be minimized during turbine control valve operational safety test stroking. When present, the turbine inlet pressure regulation or turbine power feedback must not be affected or modified to achieve the compensation.

One pre-existing method to minimize inlet pressure excursions uses turbine inlet pressure in a proportional regulator. The inlet pressure regulator design is defined and required by the steam boiler design and, thus, cannot be modified. Other methods that have been used to compensate for turbine power disturbances caused by flow changes that occur during operational testing of inlet control valves are the use of electrical power feedback in a proportional plus integral regulator, or the use of turbine-stage pressure feedback in a proportional regulator. Neither of these methods may be applied to the inlet pressure problem because they both allow inlet pressure to change. Some of these methods also involve the monitoring of additional process parameters.

BRIEF DESCRIPTION OF THE INVENTION

The present invention is a method of minimizing steam boiler pressure changes or turbine power changes during turbine control valve operational safety test stroking. The method of the present invention uses control valve positions as feedback to minimize flow disturbance caused by the closing and reopening of a turbine control valve during periodic operational testing. By maintaining the total mass flow through several parallel turbine inlet flow control valves constant, the steam generator pressure is maintained constant, and the inlet pressure regulator is unaffected during inlet control valve testing. Maintaining the total mass flow through several parallel turbine inlet control valves constant minimizes turbine power changes during inlet control valve testing. The position (valve stem lift or stroke) of the individual parallel valves is already present because it is used for closed-loop control of the inlet control valve positions. The valve position is sufficient, and results in improved performance, for the purpose of maintaining constant total flow when the method described herein is utilized. The monitoring of the available or additional process parameters for the purpose of reducing flow disturbance during inlet control valve testing, is not needed.

The flow is determined as a function of control valve position, i.e., valve stem lift. The flow change due to closure of one of the several parallel flow paths during valve testing, results in a change to the system that is controlling pressure from N valves to N-1 valves. The flow characteristic for each valve of the system with N valves, and for the system with N-1 valves, is determined during the turbine design process. The flow characteristics thus determined are based on total flow and individual valve stem lift. For any given valve not under test, the difference in the flow-lift characteristic between the N and N-1 condition is known. This difference is applied to the total flow demand to each of the N-1 valves on the basis of the total N valve demand derived from the position of the valve under test.

DETAILED DESCRIPTION OF THE INVENTION

The present invention is a method of using control valve position as feedback into a compensation function to minimize flow disturbance caused by the closing and reopening of a turbine control valve during periodic operational testing. According to the method of the present invention, total mass flow for N parallel flow valves is calculated as a function of control valve position (valve stem lift). The flow change due to closure of one of the N parallel flow valves during valve tests, results in change of the system that is controlling pressure from N valves, to N-1 valves. The flow characteristic for each valve of the system with N valves, and for the system with N-1 valves, is determined during design. The flow characteristics are based on total flow (valve) demand. For any given valve not under test, the flow difference characteristic between the N and the N-1 condition is known.

Figure 1:
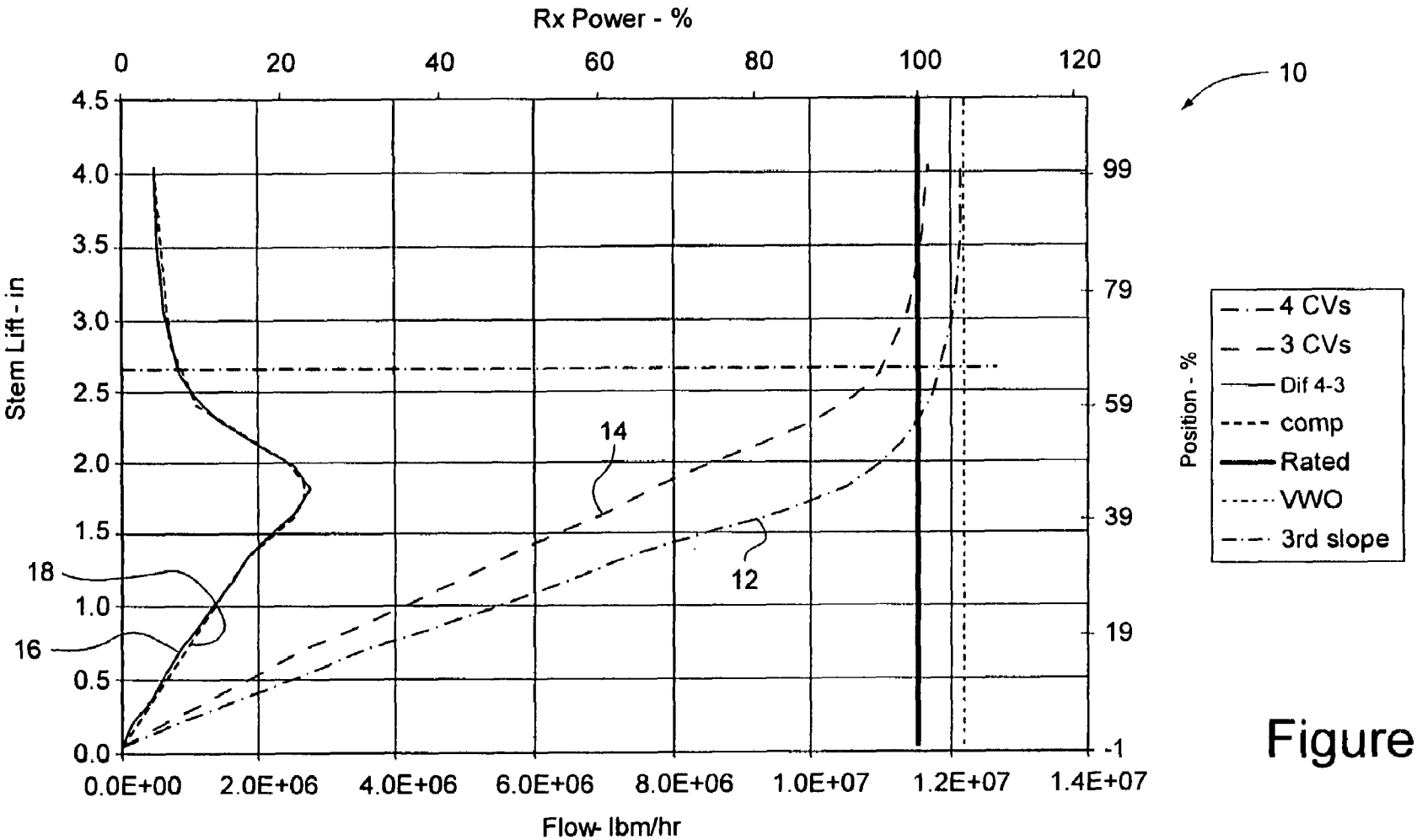
FIG. 1 is a graph showing the total flow characteristic for a system when controlling with N valves and when controlling with N-1 valves for various valve lift values. The graph also shows the flow difference between the N and the N-1 condition as a function of valve lift.

FIG. 1 is a graph 10 showing the difference in flow characteristics between N and N-1 turbine flow control valves. The bottom horizontal axis of graph 10 represents flow in pounds mass per hour (lbm/hr). The left vertical axis represents stem lift (valve opening) in inches, while the right vertical axis represents the percentage (position-%) of a valve opening with respect to the maximum opening of which the valve is capable of providing. The top horizontal axis of graph 10 represents the percentage of power of a steam turbine taking steam from a nuclear power source (Rx power-%).

Curve 12 shows the total level of flow (lbm/hr) versus stem lift (inches), for a total of four turbine control valves. Curve 14 shows the total level of flow versus stem lift for three of the four turbine control valves, where one of the control valves has been closed for test purposes. Curve 16 represents the actual difference between the total mass flow for four turbine control valves and the total mass flow for three of the turbine control valves where one of the control valves has been closed. Thus, for example, if each of the control valves in a four-valve set had a stem lift of 1", the corresponding flow for all four valves being open would be approximately 5.5E+06 lbm/hr. Conversely, if one of the four control valves were closed, the remaining three valves would produce a corresponding flow of 4.0E+06 lbm/hr where each of the three valves had a stem lift of 1". This difference is reflected in graph 16 where a stem lift of 1" on graph 16 corresponds to a flow difference of approximately 1.5E+06 lbm/hr.

Curve 18 represents a "smoothing out" of curve 16 to provide a more appropriate curve to control flow change of the three control valves remaining open to minimize flow disturbance of the fourth valve is closed and then reopened. Thus, for example, if the flow through four valves were 8.0E+06 lbm/hr, curve 12 in graph 10 indicates that each of the valves has a stem lift of approximately 1.4". If one of the valves is then closed for test purposes, to compensate for the loss of flow through the closed valve, the remaining three valves would require additional lift of approximately 0.6" per valve to maintain a flow of 8.0E+6 lbm/hr. Curve 18 can be obtained on a visual approximation basis or by using a mathematical approach, such as regression analysis.

Figure 2:
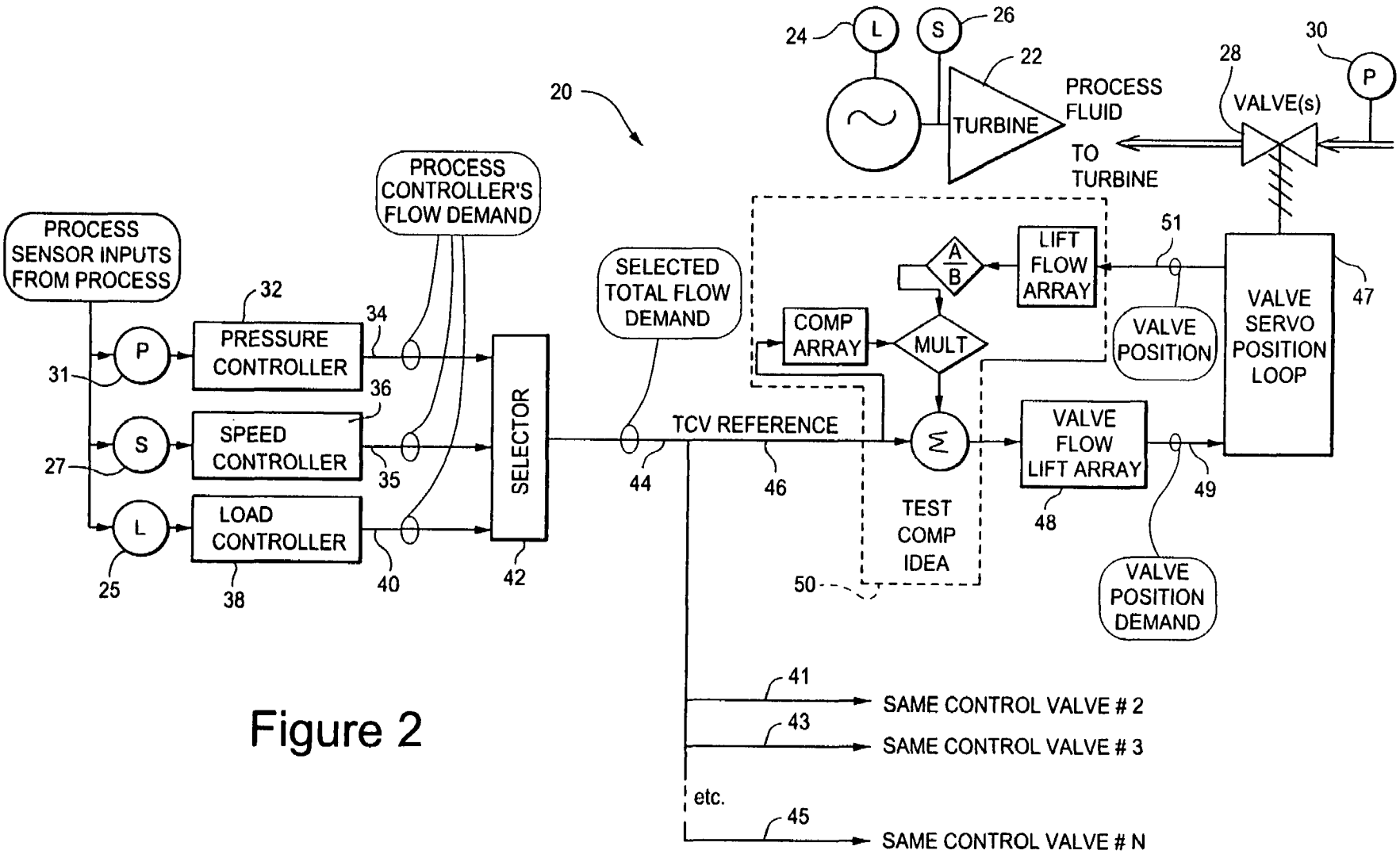
FIG. 2 is a block diagram of a control circuit for controlling the flow through the input control valves of a turbine showing the interfacing of such circuit with the flow control circuit for one valve of a total of N valves present in the turbine.

FIG. 2 is a block diagram 20 generally showing the manner in which the mass flow through each of several parallel turbine inlet control valves is controlled. As shown in FIG. 2, a turbine 22 includes several process sensors relating to the operation of the turbine. These sensors include a load sensor 24, a speed sensor 26 and a pressure sensor 30, the latter of which is connected to a control valve 28 controlling the flow of process fluid to turbine 22. The outputs of sensors 24, 26 and 30 are provided as inputs 25, 27 and 31, respectively, to a load controller 38, a speed controller 36 and a pressure controller 32 used to control the operation of turbine 22. The outputs 34, 35 and 40, respectively, of pressure controller 32, speed controller 36 and load controller 38, in combination, constitute turbine 22's processor controller's flow demand. Outputs 34, 35 and 40 are fed into a selector 42, and in combination, produce an output 44 which is the selected total flow demand used by the process controller to control the flow through the control valves providing mass flow into the inlet of turbine 22. Output 44 of selector 42 is referred to as "TCV Reference", which is a signal that effectively establishes the total flow demand for the valves to produce. In normal operation, the TCV Reference signal is fed into a test control circuit 48 which includes the means to convert the TCV reference into the required valve position and generates an output 49 that establishes Valve Position Demand. Output 49 is received by a valve servo position loop 47 which provides closed-loop position control of the lift of valve 28.

To minimize steam boiler pressure changes or turbine power changes during turbine control valve operational safety testing, the present invention uses a test compensation circuit 50. This compensation circuit uses control valve positions as feedback and compensates by adjusting the flow through parallel control valves to minimize flow disturbance caused by the closure and reopening of turbine control valve 28 during testing. Test compensation circuit 50 is shown in greater detail in FIG. 3. According to the present invention, the test compensation circuit 50 would be reproduced along with test control circuit 48 and valve servo position loop 47 for each valve of several parallel turbine inlet control valves used to control the mass flow through turbine 22. In this regard, output 44 of selector 42 would be provided as signals 41, 43 and 45 to control valves 2, 3 and N, respectively, as shown in FIG. 2.

Figure 3:
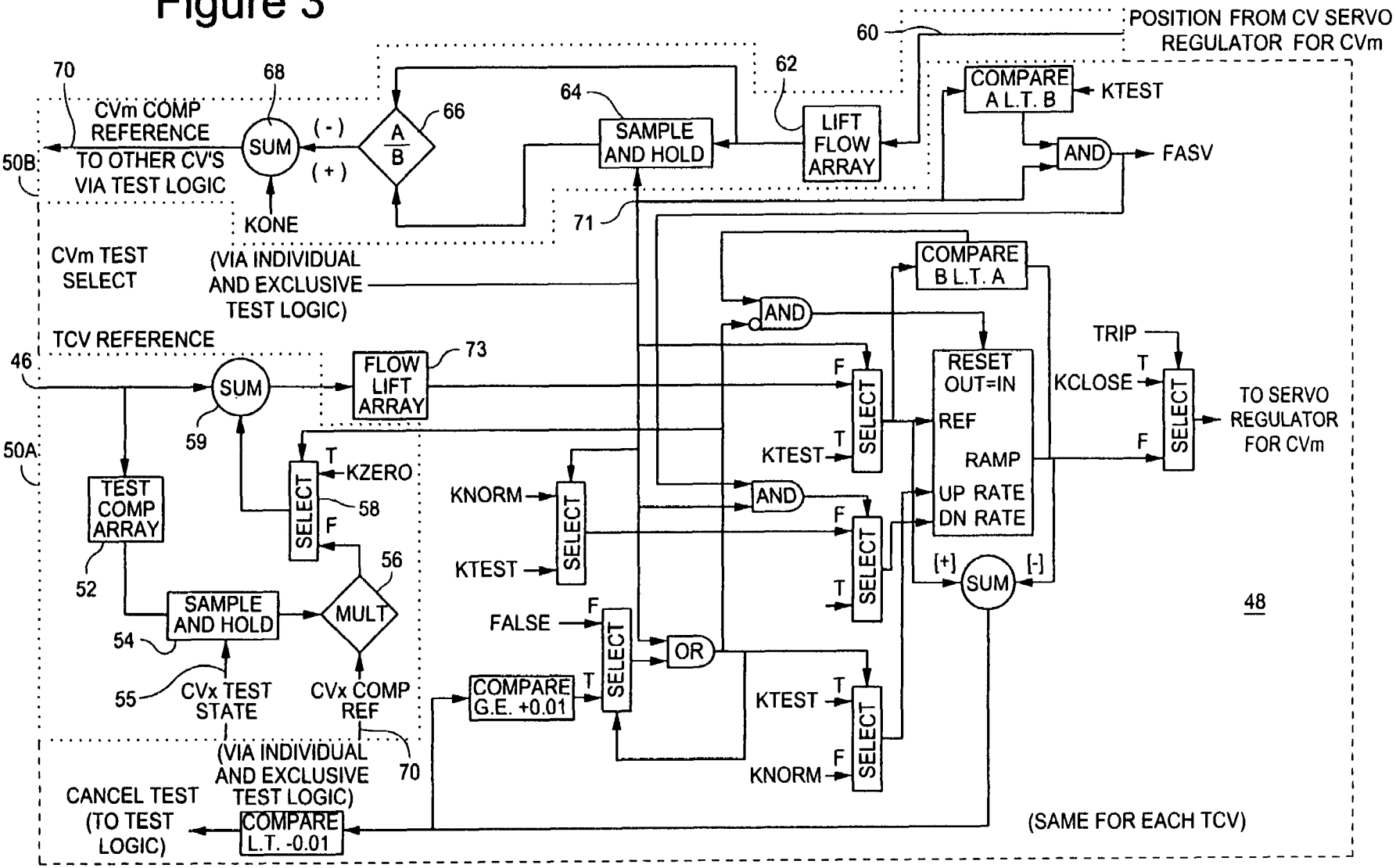
FIG. 3 is a block diagram of an exemplary flow control circuit with control valve test compensation for one valve of a total of N valves present in a turbine.

FIG. 3 is a more detailed block diagram of the test control circuit 48 commonly used to control mass flow through parallel turbine inlet control valves. Test compensation circuit 50 is also shown in more detail in FIG. 3. In particular, circuits 50A and 50B shown in FIG. 3 together constitute test compensation circuit 50 shown in FIG. 2.

Referring to block diagram 50A in FIG. 3, signal 46, TCV Reference, is input to a test compensation array 52 and a summing circuit 59. Signal, TCV Reference, is indicative of the mass flow demand for all of the parallel inlet control valves to achieve a desired level of total mass flow through turbine 22. Test compensation array 52 is essentially a "look up table" that provides the flow compensation, for the mass flow difference demanded by TCV Reference, for the three input control valves not being tested, where a fourth one of the control valves is being closed for testing. As noted above, the flow compensation required for a given TCV reference comes from curves 16 and 18 shown in FIG. 1, which show the difference in total mass flow for three turbine control valves versus four turbine control valves for different values of valve stem lift.

Figure 4:
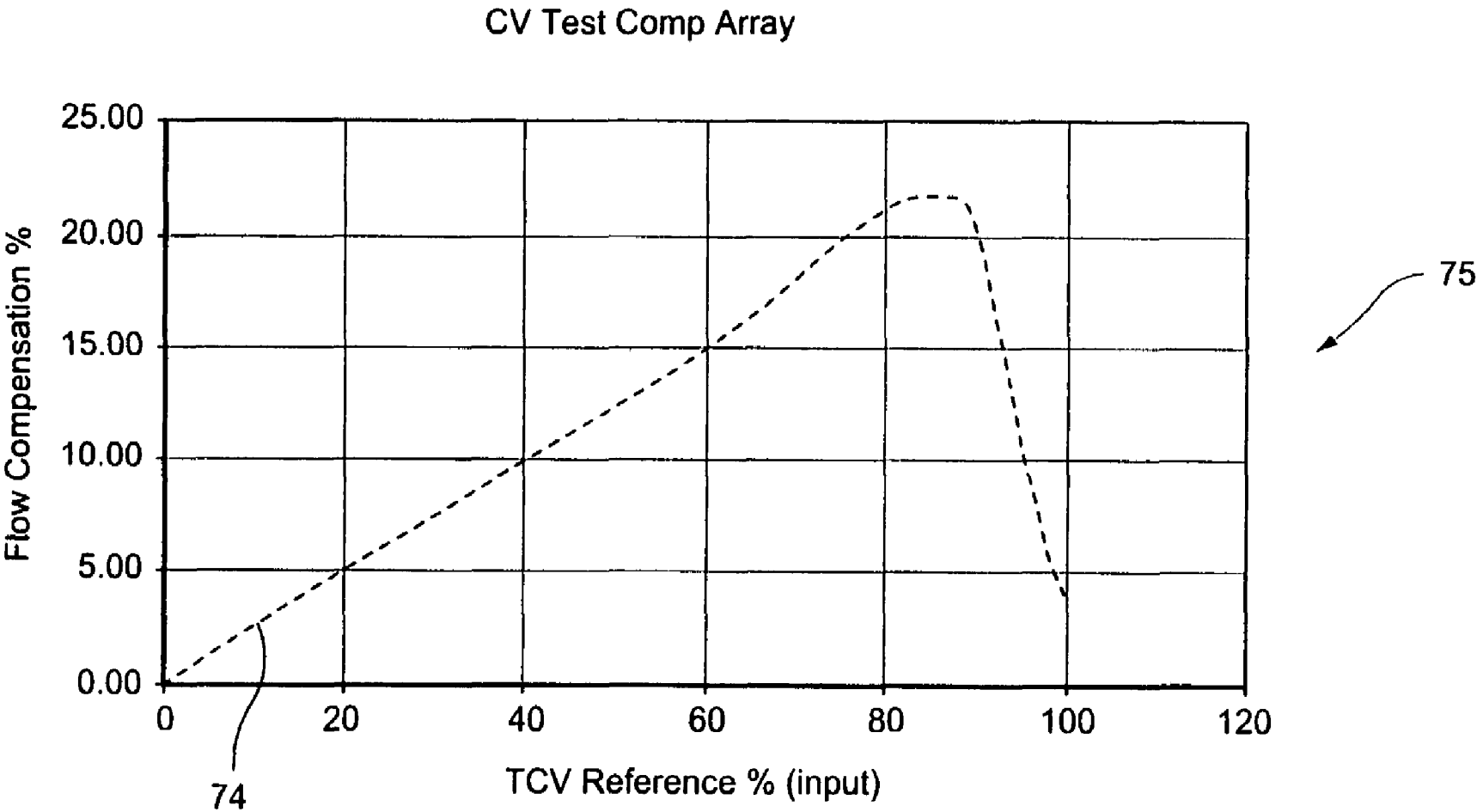
FIG. 4 is a graph of the control valve test flow compensation showing additional flow demand required for three valves to equal mass flow through four valves.

FIG. 4 is a graph effectively representing the function performed by Test Comp Array 52. The compensation array, Test Comp Array 52, is based on the mass flow being demanded ("TCV Reference"). This then skews the graph 18 shown in FIG. 1 to look like curve 74 in graph 75 of FIG. 4. The bottom horizontal axis of graph 75 represents mass flow demanded ("TCV Reference" in percentage) that is input to Test Comp Array 52. The left vertical axis represents flow compensation (in percentage) that is output from Test Comp Array 52.

The output of Test Comp Array 52 is fed into a sample and hold circuit 54, which receives a signal 55 identified as "CVx Test State". The signal, "CVx Test State", is a logic "True/False" signal generated by the activation of a test switch (not shown), which indicates whether the particular input valve controlled by circuit 48 shown in FIG. 3 (here, valve #1) is in test mode. If it is, "False" (meaning that valve #1 is not being tested) signal "CVx Test State" enables sample and hold circuit 54 to pass the output of Test Comp Array 52 into a multiplier circuit 56. Sample and hold circuit 54 provides the flow compensation for the three input control valves not under test (which include valve #1) with respect to the mass flow demanded by the TCV Reference signal.

Also inputted into multiplier circuit 56 is a second signal 70, identified as "CVx Comp Ref", which is generated by the circuit of block diagram 50B. "CVx Comp Ref" is the amount of flow compensation needed at a given TCV Reference for the for the three valves not under test.

Referring now to FIG. 50B, an input signal 60, identified as "Position From CV Servo Regulator For CVm", is input into a Lift Flow Array 62. The signal "Position From CV Servo Regulator For CVm" is dynamic signal that indicates the lift position of the valve (here, valve #1) being controlled by circuit 48 shown in FIG. 3 and the valve servo position loop (47 in FIG. 2). Lift Flow Array 62 is also essentially a "look up table" that provides, for the stem lift of valve #1, a translation to a total flow demand value for use by the three input control valves not being tested (which include valve #1), when a fourth one of the control valves is being closed for testing. As noted above, the translation to total flow demand value comes from curve 12 shown in FIG. 1, which show the total mass flow for four turbine control valves for different values of valve stem lift.

Sample and Hold Circuit 64 receives a signal 71 identified as "CVm Test Select", which is the logic "True/False" signal generated by the activation of the test switch (not shown), which selects the particular input valve controlled by test control circuit 48 shown in FIG. 3 (here, valve #1) for testing. If "CVm Test Select" is "False", it enables Sample and Hold Circuit 64 to pass the flow demand value from Lift Flow Array 62 to a Divider Circuit 66. When "CVm Test Select is "True", the flow demand value from Lift Flow Array 62 is held and passed to Divider Circuit 66. Lift Flow Array Circuit 62 also provides Divider Circuit 66 with a varying flow demand signal for the other three input control valves not under test, as the stem lift of such tested valve, such as valve #1, varies.

The denominator "B" of the divider circuit 66 is the flow demand value from Lift Flow Array 62. This value remains the same during the test closing of a given valve. The numerator "A" of the divider circuit 66 is the varying flow demand value from Lift Flow Array 62 that changes as the tested valve is closed and reopened. The output of the divider circuit 66 is a fraction that starts at 1 (meaning no compensation) and gets progressively closer to 0 (meaning 100% compensation) as the tested valve is closed.

The output of the divider circuit 66 is then fed into a summing circuit 68 which also receives an input signal identified as "K One", a reference signal with a constant value of "1". The output from Divider Circuit 66 (initially 1 for no compensation) is subtracted in Sum Circuit 68 from the fixed constant of "1" constituting signal "K One". For a given valve being tested, this subtraction produces an output of "0" that is fed into Multiplier Circuit 56 of the valves not being tested, as the signal "CVx Comp Ref". Signal "CVx Comp Ref" begins at 0, and, as the tested valve is closed, the numerator "A" in Divider Circuit 66 changes as the varying value of the lift position of the tested valve changes as the tested valve is closed and then reopened. As the output of Divider Circuit 66 gets smaller and smaller as the tested valve is closed, the output of Sum Circuit 66 increases from 0 to 1. As the tested valve is reopened, the output of Sum Circuit 66 decreases from 1 to 0. The output of summing circuit 68 is output signal 70, "CVm Comp Reference", which, as noted above, is input into multiplier circuit 56.

As also noted above, CVx Comp Ref" is an indication of the amount of flow compensation needed for the for the three valves not under test. Thus, by way of example, if valve #4 is being tested, and each of valve #s 1, 2, and 3 need to be opened from 1-inch to 1½ inches to compensate for the mass flow lost by the full closing of valve #4, the additional ½-inch" of lift is the result of the flow compensation value multiplied by a compensation factor that's going to move the lift for valves 1, 2 and 3 from 1" to 1-½" as valve #4 closes. Thus, as valve #4 is closed, the flow compensation for each of valves 1, 2, and 3 would be multiplied by "CVx Comp Ref", which is a changing signal starting out initially at 0 and increasing to 1 or 100% as valve #4 is fully closed.

The output of multiplier circuit 56 is fed into a Select Circuit 58, which also receives a second signal "K Zero", a reference signal with a constant value of "0", and a third signal from valve test control circuit 48 that determines whether reference signal "K Zero" or the output of multiplier circuit 56 is fed into Sum Circuit 59. In Sum Circuit 59, either the "0" output of Select Circuit 58 or the valve stem lift compensation signal output of Select Circuit 58 is summed with the signal "TCV Reference" and fed into a Flow Lift Array 73 that determines the valve lift of valve #1, as controlled by test control circuit 48. The logic of the test control circuit is such that the Select Circuit 58 will output the value of multiplier circuit 56 only when a valve, other than itself, is being tested.

Figure 5:
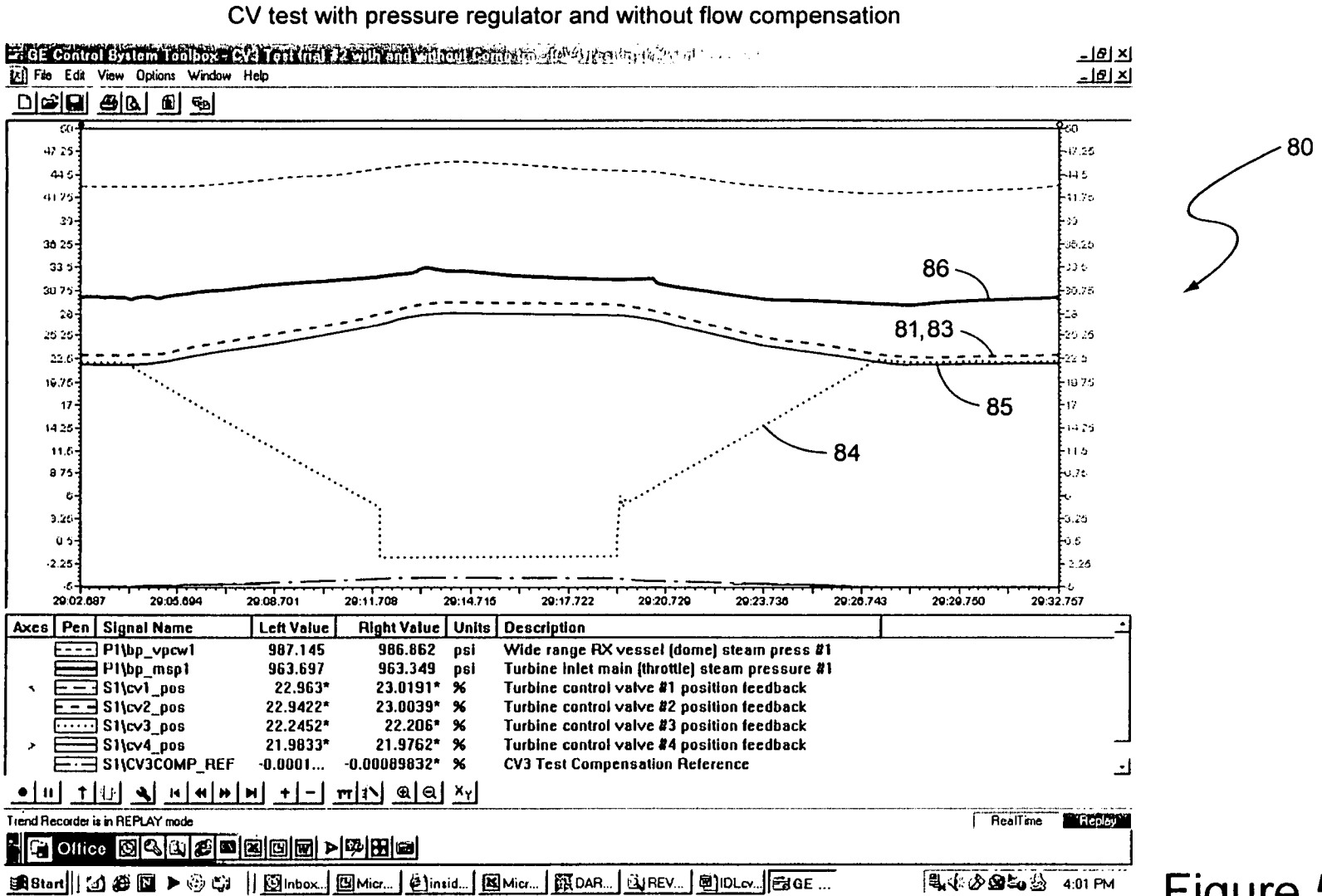
FIG. 5 is a graph of a control valve test with an inlet pressure regulator and without the flow compensation function.
Figure 6:
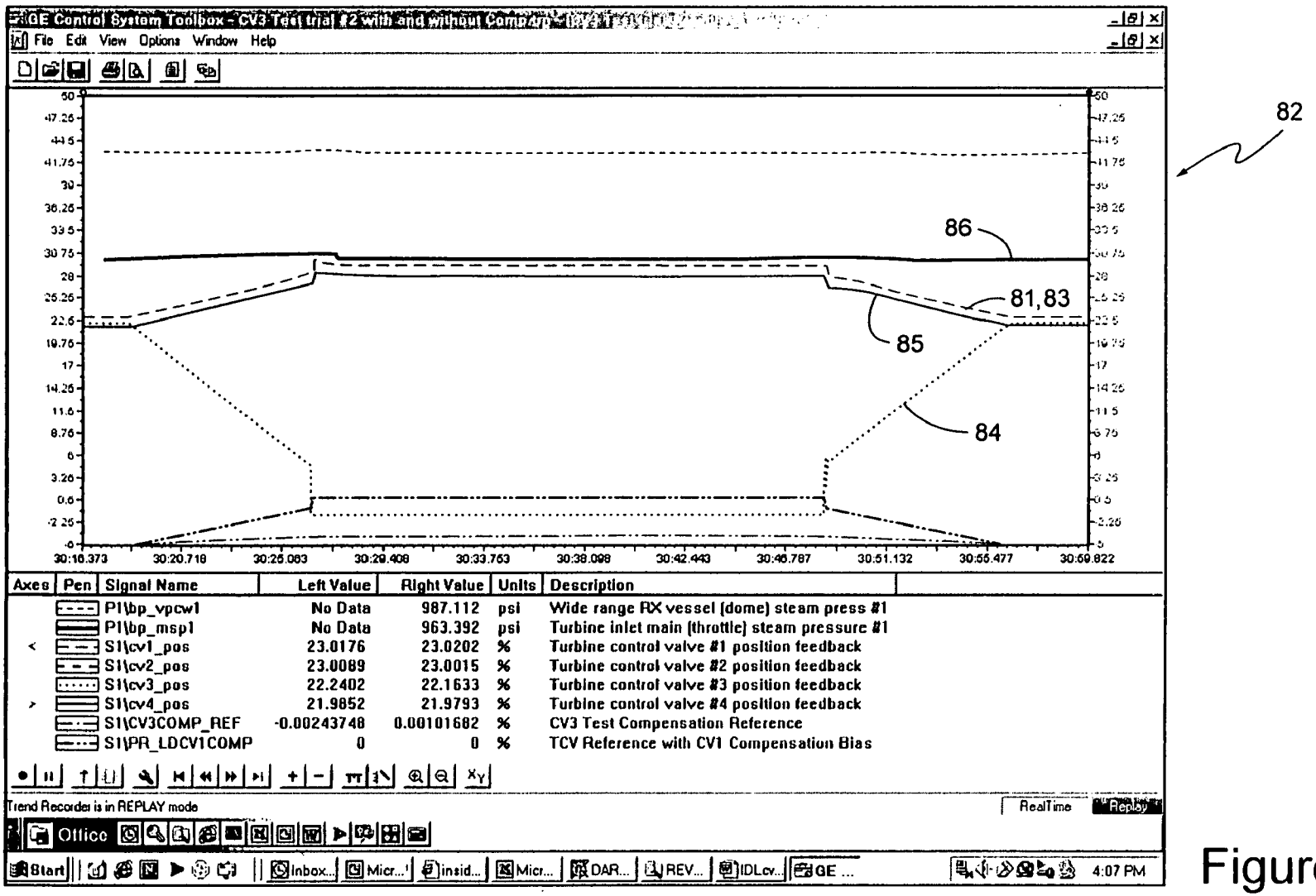
FIG. 6 is a graph of a control valve test with an inlet pressure regulator and with the flow compensation function.

To test the method and system of the present invention, a turbine system to be controlled was mathematically modeled, thermodynamically accurate, and simulated in real time. The model system consisted of source and sink with four parallel control valves individually controlling flow through four nozzles. The simulated system was connected to the embodiment of the control system of the present invention described above. The control system contained the algorithms for compensation of flow during valve testing as described above. For comparison, the control system was configured to include flow compensation and not use flow compensation. The overall control strategy requires control of pressure ahead of the valves using a proportional regulator. The use of the control valve test compensating control of the present invention reduced the pressure excursion of the turbine inlet main (throttle) steam pressure by 95%, as shown in FIGS. 5 and 6, respectively. FIG. 5 is a graph 80 that shows the results of a control valve operative test without the flow compensation of the present invention, while FIG. 6 is a graph 82 that shows the results of a control valve test with the flow compensation of the present invention. In both tests, valve #3 was the valve closed for test purposes. The position of valve #3 is shown as curve 84 in both FIGS. 5 and 6, while the pressure change in the steam pressure of the system when valve #3 is originally open, closed, and then reopened, is shown as curve 86. The position of each of valve #1, 2 and 4 is shown as curves 81, 83 and 85, respectively, in both FIGS. 5 and 6.

While the invention has been described in connection with what is presently considered to be the preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of reducing flow disturbance in a turbine including N input control valves caused by the closing and reopening of one of said valves during periodic operational testing, the method comprising the steps of:

determining total mass flow through said N valves for varying valve stem settings;

determining total mass flow through N-1 of said N valves for said varying valve stem settings;

determining the difference in total mass flow for said N valves and total mass flow for said N-1 valves;

determining a stem lift flow compensation for each of said N-1 valves not being tested, where said one test valve is being closed and reopened during operational testing using said difference in flow characteristics between total mass flow for said N valves and total mass flow for said N-1 valves;

as said one test valve is operatively tested, applying to each of said N-1 valves not being tested, said stem lift flow compensation on an increasing basis as said one test valve is being closed, and on a decreasing basis as said one tested valve is being reopened, the valve lift of said one test valve being used as feedback to control the amount of said stem lift flow compensation applied to each of said N-1 valves to minimize said flow disturbance, whereby the total mass flow through said N-1 valves remains substantially the same as the total mass flow through said N valves.

2. The method of claim 1, wherein said stem lift flow compensation is determined using a look-up table that provides an indication of said stem lift flow compensation based on the total mass flow of said N valves and the stem lift flow difference of said N-1 valves.

3. A method of reducing flow disturbance in a turbine including N input control valves caused by the closing and reopening of one of said valves during periodic operational testing, the method comprising the steps of:

determining total mass flow through said N valves for varying valve stem settings;

determining total mass flow through N-1 of said N valves for said varying valve stem settings;

determining the difference in total mass flow for said N valves and total mass flow for said N-1 valves;

determining a stem lift flow compensation for each of said N-1 valves not being tested, where said one test valve is being closed and reopened during operational testing using said difference in flow characteristics between total mass flow for said N valves and total mass flow for said N-1 valves;

as said one test valve is operatively tested, applying to each of said N-1 valves not being tested, said stem lift flow compensation on an increasing basis as said one test valve is being closed, and on a decreasing basis as said one tested valve is being reopened;

whereby the total mass flow through said N-1 valves remains substantially the same as the total mass flow through said N valves; and wherein said stem lift flow compensation is a percentage of maximum valve lift flow for each of said N-1 valves.

4. A method of reducing flow disturbance in a turbine including N input control valves caused by the closing and reopening of one of said valves during periodic operational testing, the method comprising the steps of:

determining total mass flow through said N valves for varying valve stem settings;

determining total mass flow through N-1 of said N valves for said varying valve stem settings;

determining the difference in total mass flow for said N valves and total mass flow for said N-1 valves;

determining a stem lift flow compensation for each of said N-1 valves not being tested, where said one test valve is being closed and reopened during operational testing using said difference in flow characteristics between total mass flow for said N valves and total mass flow for said N-l valves;

as said one test valve is operatively tested, applying to each of said N-1 valves not being tested, said stem lift flow compensation on an increasing basis as said one test valve is being closed, and on a decreasing basis as said one tested valve is being reopened;

whereby the total mass flow through said N-1 valves remains substantially the same as the total mass flow through said N valves; and wherein a factor that varies between "0" and "1" used to determine whether none, all, or a portion of said stem lift flow compensation is applied to each of said N-1 valves not being tested.

5. The method of claim 4, wherein when said factor is "0", none of said stem lift flow compensation is applied to each of said N-1 valves not being tested.

6. The method of claim 4, wherein when said factor is "1", all of said stem lift flow compensation is applied to each of said N-1 valves not being tested.

7. A system for reducing flow disturbance in a turbine including N input control valves caused by the closing and reopening of one of said valves during periodic operational testing, the system comprising:

means for determining total mass flow through said N valves for varying valve stem settings;

means for determining total mass flow through N-1 of said N valves for said varying valve stem settings;

means for determining the difference in flow characteristics between the total mass flow for said N valves and total mass flow for said N-1 valves;

means for determining an stem lift flow compensation for each of said N-1 valves not being tested, where said one test valve is being closed and reopened for testing using said difference in flow characteristics between total mass flow for said N valves and total mass flow for said N-1 valves;

means, as said one test valve is operatively tested, for applying to each of said N-1 valves not being tested, said stem lift flow compensation on an increasing basis as said one test valve is being closed and on a decreasing basis as said one test valve is being reopened, the valve lift of said one test valve being used by said applying means as feedback to control the amount of said stem lift flow compensation applied to each of said N-1 valves not being tested to minimize said flow disturbance;

whereby the total mass flow through said N-1 valves remains substantially the same as the total mass flow through said N valves.

8. The system of claim 7, wherein said means for determining said stem lift flow compensation is a look-up table that provides an indication of said initial stem lift compensation based on the total mass flow of said N valves and an initial lift position of said N-1 valves.

9. A system for reducing flow disturbance in a turbine including N input control valves caused by the closing and reopening of one of said valves during periodic operational testing, the system comprising:

means for determining total mass flow through said N valves for varying valve stem settings;

means for determining total mass flow through N-1 of said N valves for said varying valve stem settings;

means for determining the difference in flow characteristics between the total mass flow for said N valves and total mass flow for said N-1 valves;

means for determining an stem lift flow compensation for each of said N-1 valves not being tested, where said one test valve is being closed and reopened for testing using the difference in flow characteristics between total mass flow for said N valves and total mass flow for said N-1 valves;

means, as said one test valve is operatively tested, for applying to each of said N-1 valves not being tested, said stem lift flow compensation on an increasing basis as said one test valve is being closed and on a decreasing basis as said one test valve is being reopened;

whereby the total mass flow through said N-1 valves remains substantially the same as the total mass flow through said N valves; and wherein said stem lift flow compensation is a percentage of maximum valve lift flow for each of said N-1 valves.

10. A system for reducing flow disturbance in a turbine including N input control valves caused by the closing and reopening of one of said valves during periodic operational testing, the system comprising:

means for determining total mass flow through said N valves for varying valve stem settings;

means for determining total mass flow through N-1 of said N valves for said varying valve stem settings;

means for determining the difference in flow characteristics between the total mass flow for said N valves and total mass flow for said N-1 valves;

means for determining an stem lift flow compensation for each of said N-1 valves not being tested, where said one test valve is being closed and reopened for testing using the difference in flow characteristics between total mass flow for said N valves and total mass flow for said N-1 valves;

means, as said one test valve is operatively tested, for applying to each of said N-1 valves not being tested, said stem lift flow compensation on an increasing basis as said one test valve is being closed and on a decreasing basis as said one test valve is being reopened;

whereby the total mass flow through said N-1 valves remains substantially the same as the total mass flow through said N valves; and wherein said means for determining said initial stem lift compensation is a factor that varies between "0" and "1" that is used to determine whether none, all, or a portion of said stem lift flow compensation is applied to each of said N-1 valves not being tested.

11. The system of claim 10, wherein when said factor is "0", none of said stem lift compensation flow is applied to each of said N-1 valves not being tested.

12. The method of claim 10, wherein when said factor is "1", all of said stem lift flow compensation is applied to each of said N-1 valves not being tested.

13. A system for reducing flow disturbance in a turbine including N input control valves caused by the closing and reopening of one of said N valves during periodic operational testing, the system comprising;

a test compensation circuit for providing for the mass flow demanded by said turbine an indication of stem lift flow compensation for each of N-1 of said N input control valves not being operationally tested;

a first sample and hold circuit for sampling said stem lift flow compensation output by said test compensation circuit when said first sample and hold circuit detects an indication that its corresponding valve is not under test, and for holding the sampled value when it receives indication that another valve is being tested;

a multiplier circuit for determining the portion of said stem lift flow compensation to be applied to said corresponding valve based on a factor for applying none, all, or a portion of said stem lift flow compensation as said test valve is closed and reopened;

a circuit for providing a mass flow translation for said corresponding valve based on the lift position of said corresponding valve;

a second sample and hold circuit for sampling said mass flow translation when said second sample and hold circuit receives an indication that said corresponding valve is not under test, and for holding the sampled value when it receives indication that said corresponding valve is being tested;

a divider circuit for dividing a varying mass flow translation signal by said sample and hold mass flow translation signal; and a summing circuit for receiving the quotient of the divider circuit to generate said compensation factor for determining the portion of said stem lift flow compensation to said corresponding valve as said test valve is closed and reopened;

whereby the total mass flow through said N-l valves remains substantially the same as the total mass flow through said N valves.

14. The system according to claim 13, wherein the summing circuit receives a fixed constant signal of a predetermined value from which the quotient of the dividing circuit is subtracted to determine the compensation factor.

* * * * *